US012685377B2

(12) United States Patent
Peel

(10) Patent No.: US 12,685,377 B2
(45) Date of Patent: Jul. 21, 2026

(54) HAIRCARE APPLIANCE

(71) Applicant: Dyson Technology Limited, Wiltshire (GB)

(72) Inventor: Ayrton Lloyd Taylor Peel, Gloucester (GB)

(73) Assignee: Dyson Technology Limited, Malmesbury (GB)

( * ) Notice: Subject to any disclaimer, the term of this patent is extended or adjusted under 35 U.S.C. 154(b) by 576 days.

(21) Appl. No.: 18/268,327

(22) PCT Filed: Dec. 10, 2021

(86) PCT No.: PCT/GB2021/053245
§ 371 (c)(1),
(2) Date: Jun. 20, 2023

(87) PCT Pub. No.: WO2022/136829
PCT Pub. Date: Jun. 30, 2022

(65) Prior Publication Data

US 2024/0306787 A1 Sep. 19, 2024

(30) Foreign Application Priority Data

Dec. 23, 2020 (GB) ..... 2020486

(51) Int. Cl.
*A45D 20/12* (2006.01)

(52) U.S. Cl.
CPC ..... *A45D 20/122* (2013.01)

(58) Field of Classification Search
CPC ..... A45D 20/122
USPC ..... 34/95–100
See application file for complete search history.

(56) References Cited

U.S. PATENT DOCUMENTS 1,775,704 A 9/1930 Suter
2,074,018 A 3/1937 Gross
2,464,776 A 3/1949 Murphy
(Continued)

FOREIGN PATENT DOCUMENTS

CH 257884 A 10/1948
CH 341957 A 10/1959
(Continued)

OTHER PUBLICATIONS

Examination Report received for GB Application No. 2020489.7, mailed on Apr. 5, 2023, 2 pages.
(Continued)

*Primary Examiner* — Stephen M Gravini
(74) *Attorney, Agent, or Firm* — Tucker Ellis LLP; Michael G. Craig

(57) ABSTRACT

Disclosed is a haircare appliance including: an air inlet; an air outlet; an airflow generator for generating an airflow from the air inlet to the air outlet; a heater for heating the airflow; and a hair treatment chamber for receiving hair, the hair treatment chamber in fluid communication with the air outlet. The hair treatment chamber includes a wall, an opening through which hair is insertable into the hair treatment chamber, and an aperture formed in the wall. The haircare appliance includes a first configuration in which airflow through the aperture is unrestricted and a second configuration in which airflow through the aperture is restricted.

18 Claims, 7 Drawing Sheets

(56) References Cited

U.S. PATENT DOCUMENTS

| | | | | | |
|---|---|---|---|---|---|
| 2,933,753 | A * | 4/1960 | Woodhull | A47L 9/02 15/360 |
| 3,320,679 | A | 5/1967 | Collins | |
| 3,495,343 | A * | 2/1970 | Duncanson | A45D 20/44 392/379 |
| 3,702,031 | A | 11/1972 | Ryckman | |
| 3,731,396 | A | 5/1973 | McLean | |
| 3,822,484 | A | 7/1974 | Reed | |
| 3,832,789 | A | 9/1974 | Bartram | |
| 3,999,305 | A | 12/1976 | Driessen et al. | |
| 4,019,260 | A * | 4/1977 | Levy | A45D 20/122 239/389 |
| 4,097,722 | A * | 6/1978 | Soler | A45D 20/122 239/455 |
| 4,744,154 | A | 5/1988 | Bollinger et al. | |
| 5,235,760 | A | 8/1993 | Bastien | |
| 5,297,942 | A | 3/1994 | Fleishman et al. | |
| 5,488,783 | A | 2/1996 | Parkinson et al. | |
| 6,038,782 | A * | 3/2000 | Schepisi | A45D 20/122 392/374 |
| 6,089,239 | A | 7/2000 | Ehlhardt et al. | |
| 6,269,549 | B1 | 8/2001 | Carlucci et al. | |
| 6,293,030 | B1 | 9/2001 | McCurtis et al. | |
| 8,707,577 | B2 * | 4/2014 | Lee | A45D 20/12 34/100 |
| 9,930,950 | B1 * | 4/2018 | Cage | A45D 20/12 |
| 11,172,744 | B2 * | 11/2021 | French-Jackson | A45D 20/12 |
| 12,507,781 | B2 * | 12/2025 | Higgins | A45D 20/122 |
| 2011/0079239 | A1 | 4/2011 | Hall | |
| 2011/0277335 | A1 | 11/2011 | Prehodka | |
| 2012/0291301 | A1 | 11/2012 | Silva | |
| 2013/0269205 | A1 | 10/2013 | Hada | |
| 2017/0231359 | A1 | 8/2017 | Taylor | |
| 2018/0140070 | A1 | 5/2018 | Hillebrecht et al. | |
| 2019/0075905 | A1 | 3/2019 | Kennedy et al. | |
| 2019/0166969 | A1 | 6/2019 | Brownlee | |
| 2019/0313761 | A1 | 10/2019 | Gebhard | |
| 2024/0065408 | A1 * | 2/2024 | Peel | A45D 20/12 |
| 2024/0285054 | A1 * | 8/2024 | Atkinson | A45D 2/001 |
| 2024/0306787 | A1 * | 9/2024 | Peel | A45D 20/122 |
| 2024/0423343 | A1 * | 12/2024 | Atkinson | A45D 1/04 |

FOREIGN PATENT DOCUMENTS

| | | | | |
|---|---|---|---|---|
| CN | 2598409 | Y | 1/2004 | |
| CN | 205162247 | U | 4/2016 | |
| CN | 107752312 | A | 3/2018 | |
| CN | 108078141 | A | 5/2018 | |
| CN | 208064717 | U | 11/2018 | |
| CN | 208192499 | U | 12/2018 | |
| CN | 208286601 | U | 12/2018 | |
| CN | 109480440 | A | 3/2019 | |
| CN | 111387671 | A | 7/2020 | |
| CN | 116744818 | A * | 9/2023 | A45D 20/122 |
| DE | 9214397 | U1 | 12/1992 | |
| DE | 102012220756 | A1 | 5/2014 | |
| EP | 1041902 | A1 | 10/2000 | |
| EP | 2532266 | A1 | 12/2012 | |
| EP | 4266945 | A1 | 11/2023 | |
| GB | 0329990 | A | 5/1930 | |
| GB | 576823 | A | 4/1946 | |
| GB | 1304560 | A | 1/1973 | |
| GB | 2525691 | A | 11/2015 | |
| GB | 2602323 | A * | 6/2022 | A45D 20/122 |
| GB | 2602325 | A | 6/2022 | |
| JP | H057508 | A | 1/1993 | |
| JP | 2017006666 | A | 1/2017 | |
| JP | 6275909 | B1 | 2/2018 | |
| JP | 3219559 | U | 1/2019 | |
| JP | 2020062401 | A | 4/2020 | |
| KR | 20100008631 | A | 1/2010 | |
| KR | 20120033423 | A | 4/2012 | |
| KR | 20180017193 | A | 2/2018 | |
| KR | 10-2200617 | B1 | 1/2021 | |
| RU | 2132147 | C1 | 6/1999 | |
| TW | M448940 | U | 3/2013 | |
| WO | 97/09899 | A1 | 3/1997 | |
| WO | 2007/105069 | A2 | 9/2007 | |
| WO | WO-2013158626 | A1 * | 10/2013 | A45D 20/122 |
| WO | 2015/083992 | A1 | 6/2015 | |
| WO | 2017177272 | A1 | 10/2017 | |
| WO | WO-2019108735 | A1 * | 6/2019 | A45D 20/12 |
| WO | 2022/136826 | A1 | 6/2022 | |
| WO | 2022/136833 | A1 | 6/2022 | |
| WO | 2022/136837 | A1 | 6/2022 | |
| WO | WO-2022136829 | A1 * | 6/2022 | A45D 20/122 |

OTHER PUBLICATIONS

International Search Report and Written Opinion received for PCT Patent Application No. PCT/GB2021/053245, mailed on Feb. 24, 2022, 9 pages.

International Search Report and Written Opinion received for PCT Patent Application No. PCT/GB2021/053287, mailed on Feb. 24, 2022, 10 pages.

International Search Report and Written Opinion received for PCT Patent Application No. PCT/GB2021/053288, mailed on Feb. 22, 2022, 10 pages.

International Search Report and Written Opinion received for PCT Patent Application No. PCT/GB2021/053324, mailed on May 16, 2022, 15 pages.

Examination Report received for GB Application No. 2020486.3, mailed on Apr. 3, 2023, 2 pages.

Examination Report received for GB Application No. 2020487.1, mailed on Oct. 25, 2022, 2 pages.

Search Report received for GB Application No. 2020484.8, mailed on Jun. 18, 2021, 1 page.

Search Report received for GB Application No. 2020486.3, mailed on Jun. 2, 2021, 2 pages.

Search Report received for GB Application No. 2020487.1, mailed on Jun. 17, 2021, 1 page.

Search Report received for GB Application No. 2020489.7, mailed on Jun. 1, 2021, 1 page.

Examination Report received for GB Application No. 2020484.8, mailed on Nov. 30, 2023, 3 pages.

* cited by examiner

HAIRCARE APPLIANCE

CROSS-REFERENCE TO PRIOR APPLICATION

This application is a § 371 National Stage Application of PCT International Application No. PCT/GB2021/053245 filed Dec. 10, 2021, which claims the priority of United Kingdom Application No. 2020486.3, filed Dec. 23, 2020, each of which are herein incorporated by reference in their entirety.

FIELD OF THE INVENTION

The present invention relates to a haircare appliance, and an attachment for a haircare appliance.

BACKGROUND OF THE INVENTION

Haircare appliances are generally used to treat or style hair, and some may treat or style hair using airflow.

SUMMARY OF THE INVENTION

According to a first aspect of the present invention there is provided an attachment for a haircare appliance, the attachment comprising an air inlet, an air outlet for emitting an airflow, and a hair treatment chamber for receiving hair, the hair treatment chamber in fluid communication with the air outlet; wherein the hair treatment chamber comprises a wall, an opening through which hair is insertable into the hair treatment chamber, and an aperture formed in the wall, and wherein the attachment comprises a first configuration in which airflow through the aperture is unrestricted and a second configuration in which airflow through the aperture is restricted.

The attachment may also comprise a heater for heating the airflow.

The attachment according to the first aspect of the present invention may be advantageous as it may provide greater control over temperature within the hair treatment chamber. In the second configuration, airflow through the aperture is restricted. As such, the temperature within the chamber will increase. This may increase the efficiency and/or speed of drying a user's hair. In the first configuration, airflow through the aperture is unrestricted. As such, the temperature within the chamber may be decreased. This may increase the comfort of the user by preventing the air within the hair treatment chamber from becoming too hot.

In the second configuration, airflow may still pass through the aperture (i.e. airflow through the aperture is not prevented) to allow for further regulation of the temperature within the chamber. Alternatively, airflow may be prevented from flowing through the aperture in the second configuration. This may help to increase the speed at which the temperature within the chamber increases.

The attachment or haircare appliance may be operable such that airflow through the aperture is restricted by varying amounts. For example, the haircare appliance may be operable to allow the user to select how much the airflow through the aperture is restricted. This may provide the user with more control over the use of the haircare appliance.

The attachment may be biased into the first configuration. As such, the attachment may be biased such that airflow through the aperture is unrestricted. This may help to prevent the temperature within the chamber from becoming inadvertently too hot.

The wall of the hair treatment chamber may comprise an outer wall section and an inner wall section. The aperture may be formed in the outer wall section, and the inner wall section may be disposed adjacent the inner wall section. For example, if the outer wall section defines a hemi-spherical interior of the hair treatment chamber, the inner wall section may also define a hemi-spherical shape and may be disposed radially adjacent the outer wall section. In other words, the inner wall section may be provided within the hemi-spherical interior of the hair treatment chamber.

The inner wall section may comprise an orifice corresponding to the aperture of the outer wall section. The inner wall section may take the same form as the outer wall section. In other words, the inner wall section may be a copy of the outer wall section. The orifice may have the same dimensions as the aperture. The outer wall may comprise a plurality of apertures and the inner wall may comprise a corresponding plurality of orifices.

The inner wall section may be moveable relative to the outer wall section. For example, the inner wall section may slide over and within the outer wall section.

In the first configuration, the aperture of the outer wall section may be at least partially aligned with the orifice of the inner wall section. In the second configuration, the aperture of the outer wall section may be at least partially misaligned with the orifice of the inner wall section. As such, in the second configuration, the inner wall section may obstruct the aperture to restrict airflow through the aperture.

The inner wall section may comprise a solid body in which the orifice is formed. The aperture of the outer wall section may be entirely misaligned with the orifice of the inner wall section such that the aperture is occluded by the solid body to prevent airflow through the aperture.

The outer wall section may be fixed relative to the air inlet. The inner wall section may be moveable within the outer wall section. As the moveable part is within the hair treatment chamber (and not of the outside of the hair treatment chamber), this helps to prevent the user from potentially trapping their fingers in the moveable part and helps to prevent the build-up of dirt inhibiting the movement of the moveable part.

The inner wall section may be fixed relative to the air inlet. The outer wall section may be moveable around the inner wall section. As the moveable part is on the outside of the hair treatment chamber, this may help to prevent the user trapping their hair in the moveable part.

The attachment may comprise a switching arrangement configured to switch the attachment between the first configuration to the second configuration. The switching arrangement may comprise a ratchet, a rack and pinion arrangement, a lever, a gear arrangement, a wedge cam or any other arrangement suitable to switch the attachment from the first configuration to the second configuration. This may allow for the attachment to be switched from the first configuration to the second configuration either manually or automatically.

The switching arrangement may be configured to switch the attachment between the first configuration and the second configuration by moving the inner wall section relative to the outer wall section.

For example, the rack and pinion arrangement may comprise a rotatable gear which may be engageable with a linear gear to cause movement of the inner wall section relative to the outer wall section when the switching arrangement is actuated. The ratchet may comprise a rotatable gear that it rotatable to cause movement of the inner wall section relative to the outer wall section when the switching arrangement is actuated. The lever may be configured to rotate about a fulcrum to cause movement of the inner wall section relative to the outer wall section when the switching arrangement is actuated. The gear arrangement may comprise a plurality of rotatable gears which may be rotatable to cause movement of the inner wall section relative to the outer wall section when the switching arrangement is actuated. The wedge cam may comprise a cam and a follower which may be moveable to cause movement of the inner wall section relative to the outer wall section when the switching arrangement is actuated.

The opening of the hair treatment chamber may be defined by a rim. The rim may form part of the switching arrangement and may be depressible in the same direction as airflow from the air outlet. The rim may be depressible in response to a force applied to the rim. The rim may at least partially define the air outlet. The switching arrangement may be configured to switch the attachment from the first configuration to the second configuration when a force is applied to the rim. The rim may be arranged such that, in use, when a user places attachment against their head, a force is applied to the rim. This may cause the rim to be depressed to trigger the switching arrangement. For example, the rim may be operatively connected to the inner wall section such that movement of the rim also causes movement of the inner wall section relative to the outer wall section. By depressing the rim, the attachment may be switched between the first and second configurations by the user in the process of drying their hair. For example, the user may not have to use their other hand to switch the attachment between the first and second configurations. As such, this may provide a more convenient and improved user experience.

The switching arrangement may comprise a protrusion extending from a part of the attachment. For example, the protrusion may extend from the hair treatment chamber such that it is perpendicular to the head of a user in use. The protrusion may extend from the rim of the hair treatment chamber or may be provided in communication with the rim. The switching arrangement may be configured to switch the attachment from the first configuration to the second configuration when a force is applied to the protrusion. The protrusion may be arranged such that, in use, when a user places the attachment against their head, a force is applied to the protrusion. This may cause the protrusion to be depressed to trigger the switching arrangement.

The air outlet may be configured to direct airflow away from the opening and toward the aperture in use. As such, the airflow may initially be directed away from the head of the user in use. This may reduce an amount of direct heat being applied to the user's head which may increase the comfort of using the attachment, particularly over an extended period of time.

The hair treatment chamber may hold the user's hair in place during use such that the user's hair is less likely to be disrupted by the flow of air into the hair treatment chamber. As such, relatively high flow rates of air can be used without significantly disrupting the user's hair, which may increase the efficiency and/or speed of drying the user's hair. The flow rate may be at least 6 litres per second, at least 10 litres per second, or at least 13 litres per second.

The air outlet may be configured to direct airflow substantially along a surface of the wall in use. The wall of the hair treatment chamber may be shaped to further direct the airflow in use. For example, the wall may be curved and the airflow may be directed to follow the curve of the wall. This may cause the airflow to remain in contact with the wall and be further directed away from the opening. Airflow may flow from the air outlet into an interior of the hair treatment chamber in use.

The hair treatment chamber, for example the wall of the hair treatment chamber, may be shaped to define a hemispherical interior. This may help to maximise the space available in the hair treatment chamber to receive the user's hair. The hair treatment chamber may be shaped to define a substantially toroidal shape. For example, the hair treatment chamber may be shaped such that the wall of the hair treatment chamber has a peak at the centre of the hair treatment chamber, the peak being adjacent the opening. The toroidal shape of the hair treatment chamber may help to direct airflow toward the head of a user, or roots of a user's hair, in use when in the second configuration. This may help to increase the efficiency of drying the user's hair. The hair treatment chamber may be any suitable shape to hold the user's hair in use.

The wall may comprise a porous material. The porous material may define the aperture. The porous material may be, for example, a mesh. The porous material may be air permeable such that air can flow through the permeable material. The porous material may help to retain the hair of a user within the hair care chamber while also confining the air in the hair treatment chamber. As such, air in the hair treatment chamber may heat to higher temperatures to increase the efficiency and/or speed of drying the user's hair.

The wall of the attachment may compromise a plurality of apertures. For example, there may be two, four, six, eight, ten, one hundred, one thousand or ten thousand apertures. The plurality of apertures may be spaced about a periphery of the hair treatment chamber. In the first configuration airflow through the plurality of apertures may be unrestricted and in the second configuration airflow through the plurality of apertures may be restricted. Providing a plurality of apertures may provide more diffuse air flow from the hair treatment chamber in use.

The attachment may comprise a sensor configured to output a signal indicative of a property of hair within the hair treatment chamber. This signal may be indicative of the user's hair being sufficiently dry and, for example, the user may be provided with an indication to stop using the attachment based on the signal. For example, the user may be provided with a visual indicator, such as a light, when the signal indicates that their hair is sufficiently dry. The airflow generator may be configured to modify the airflow when the signal indicates that the user's hair is sufficiently dry. For example, the airflow generator may be configured to reduce the flow rate, or stop the generation of airflow, in response to the signal. Alternatively or additionally, the heater may be configured to modify the amount of heat provided to the airflow in response to the signal. For example, the heater may be configured to reduce the amount of heat provided to the airflow, or stop heating the airflow, in response to the signal. This may help to prevent damage to the user's hair which may be caused by excessive or unnecessary drying and/or heating.

The attachment may be configured to switch from the second configuration to the first configuration in response to the signal. For example, if the signal is indicative of the user's hair being sufficiently dry, the attachment may be configured to switch to the first configuration to prevent damage to the user's hair which may be caused by excessive or unnecessary drying and/or heating.

The sensor may be in located within or adjacent to the hair treatment chamber. Multiple sensors may be provided to provide redundancy in the event of a sensor failing.

The sensor may comprise any of a temperature sensor, humidity sensor, a sensor capable of spectral analysis, or a sensor capable of capacitive sensing for moisture.

According to a second aspect of the present invention there is provided a haircare appliance comprising:

an air inlet;

an air outlet;

an airflow generator for generating an airflow from the air inlet to the air outlet;

and a hair treatment chamber for receiving hair, the hair treatment chamber in fluid communication with the air outlet;

wherein the hair treatment chamber comprises a wall, an opening through which hair is insertable into the hair treatment chamber, and an aperture formed in the wall, and wherein the haircare appliance comprises a first configuration in which airflow through the aperture is unrestricted and a second configuration in which airflow through the aperture is restricted.

The haircare appliance may comprise a handle unit within which the airflow generator is disposed, and an attachment comprising the air inlet, the air outlet and the hair treatment chamber, the attachment removably attachable to the handle unit. Providing the air inlet, hair treatment chamber, and air outlet described above as part of a removable attachment may allow the functionality described herein to be selectively provided by a user.

The attachment may be for a haircare appliance comprising an airflow generator disposed in a handle unit. The attachment may communicate with the handle unit, or other component of the haircare appliance, to modify operation of the haircare appliance. For example, the attachment may communicate with the airflow generator to modify the airflow provided to the attachment. The attachment may communicate with the haircare appliance to transfer information indicative of a desired air flow rate. The airflow generator may be operated on the basis of the information to provide the desired air flow rate. The attachment may comprise an RFID tag which includes information indicative of the air flow rate desired for the attachment. This information may be read from the RFID tag and transmitted to the airflow generator to cause the airflow generator to generate airflow with the desired flow rate. Alternatively or additionally, the attachment may communicate with the haircare appliance by Bluetooth™ or other suitable wireless communication standard, and/or by a wired connection.

Optional features of aspects of the present invention may be equally applied to other aspects of the present invention, where appropriate

DETAILED DESCRIPTION OF THE INVENTION

Figure 1:
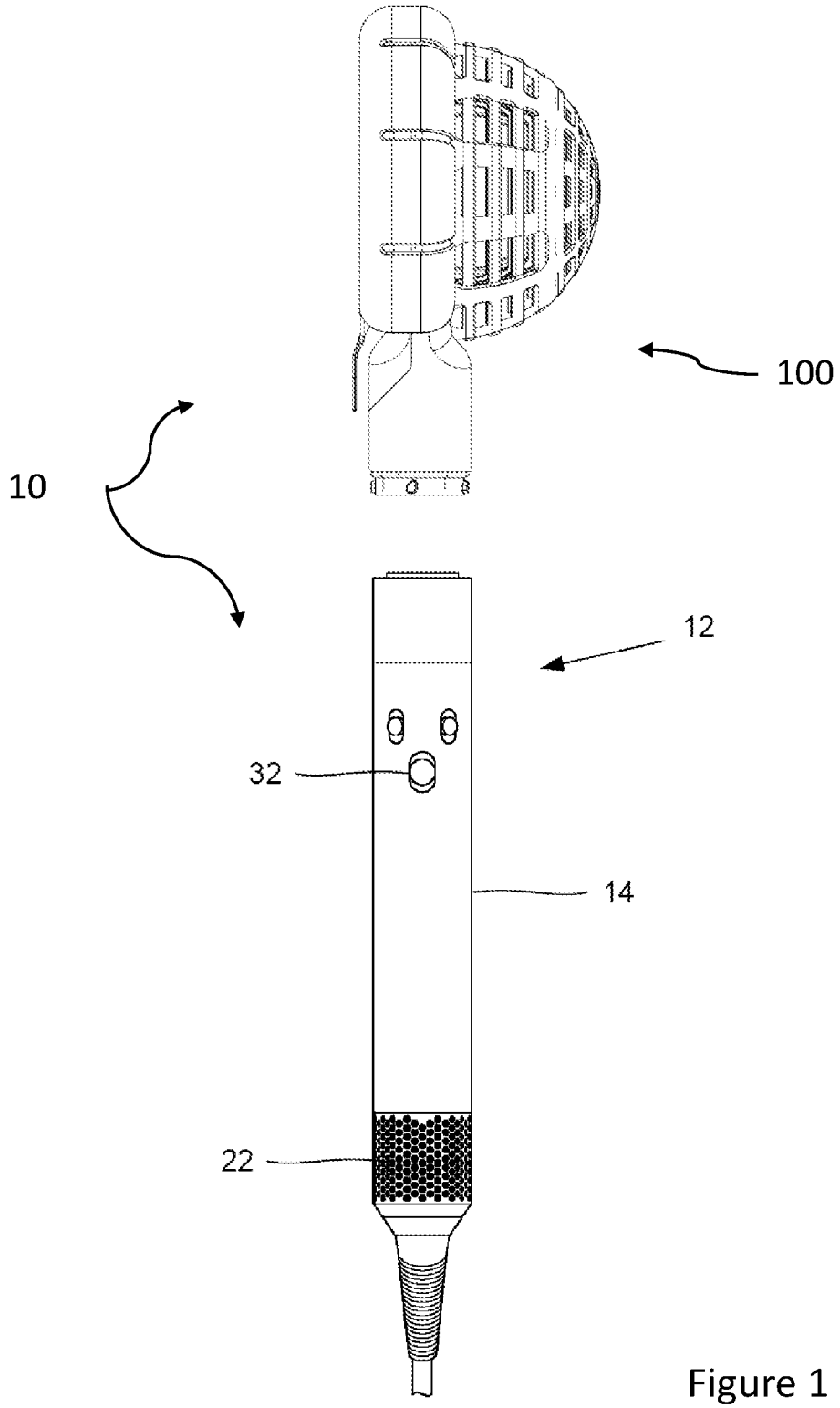
FIG. 1 is a schematic view of a haircare appliance according to an example.

A haircare appliance according to the present invention, generally designated 10, is shown schematically in FIG. 1.

The haircare appliance 10 comprises a handle unit 12, and an attachment 100 removably attachable to the handle unit 12.

Figure 2:
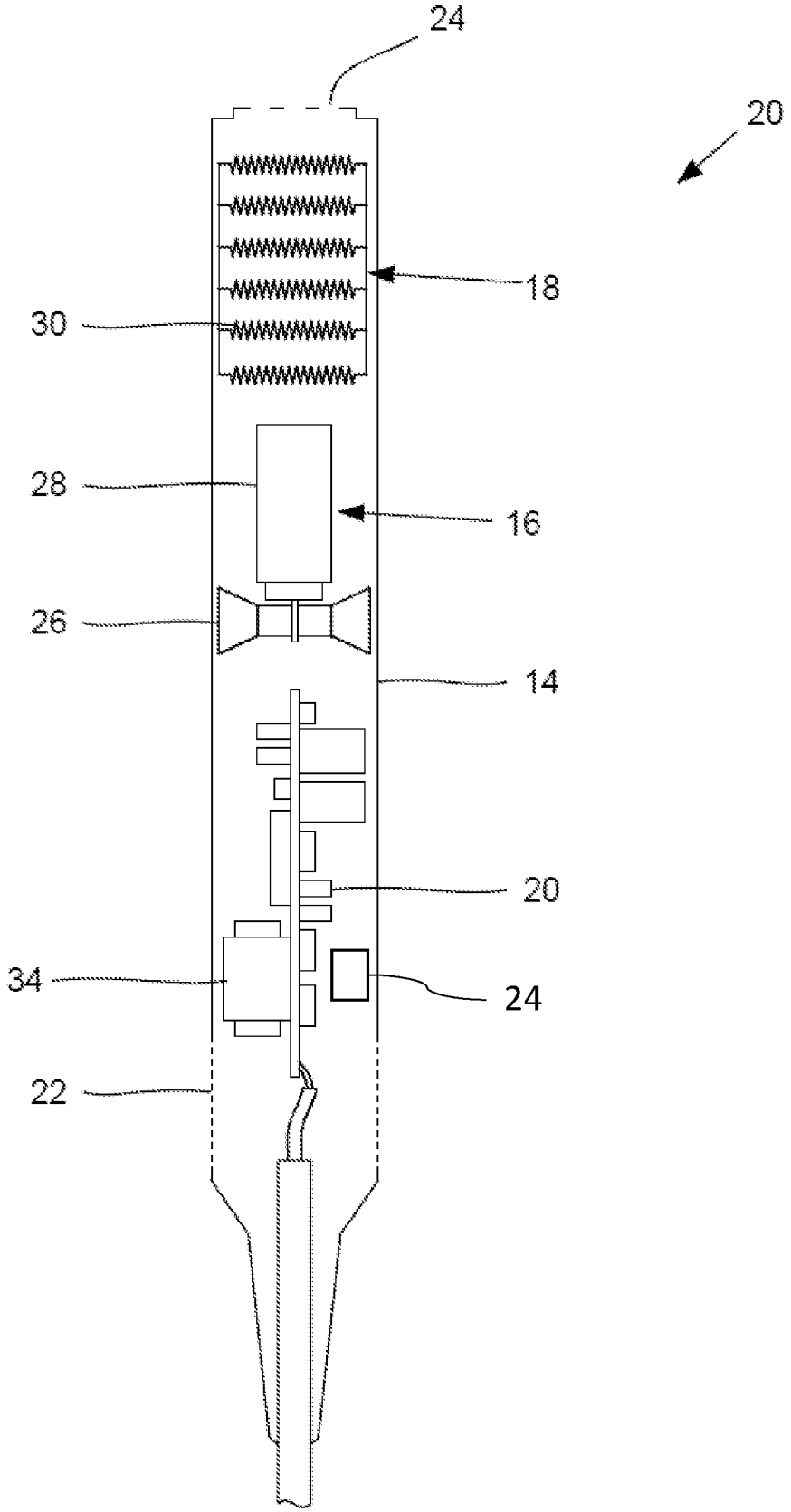
FIG. 2 illustrates a schematic cross-sectional view of a handle unit of the haircare appliance of FIG. 1.

The handle unit 12 comprises a housing 14, an airflow generator 16, a heater 18, and a control unit 20, as can be seen schematically in FIG. 2.

The housing 14 is tubular in shape, and comprises an air inlet 22 through which an airflow is drawn into the housing 14 by the airflow generator 16, and an air outlet 24 through which the airflow is discharged from the housing 14. The airflow generator 16 is housed within the housing 14, and comprises an impeller 26 driven by an electric motor 28. The heater 18 is also housed within the housing 14, and comprises heating elements 30 to optionally heat the airflow.

The control unit 20 comprises electronic circuitry for a user interface 32, a control module 34 and an RFID reader 24. The user interface 32 is provided on an outer surface of the housing 14, and is used to power on and off the haircare appliance 10, to select a flow rate (for example high, medium and low), and to select an airflow temperature (for example hot, medium or cold). In the example of FIG. 1, the user interface comprises a plurality of sliding switches, but other forms of user interface 32, for example buttons, dials or touchscreens, are also envisaged. The RFID reader 24 is to interrogate an RFID tag that forms part of the attachment 100.

The control module 34 is responsible for controlling the airflow generator 16, and the heater 18 in response to inputs from the user interface 32. For example, in response to inputs from the user interface 32, the control module 34 may control the power or the speed of the airflow generator 16 in order to adjust the airflow rate of the airflow, and the power of the heater 18 in order to adjust the temperature of the airflow.

Figure 3:
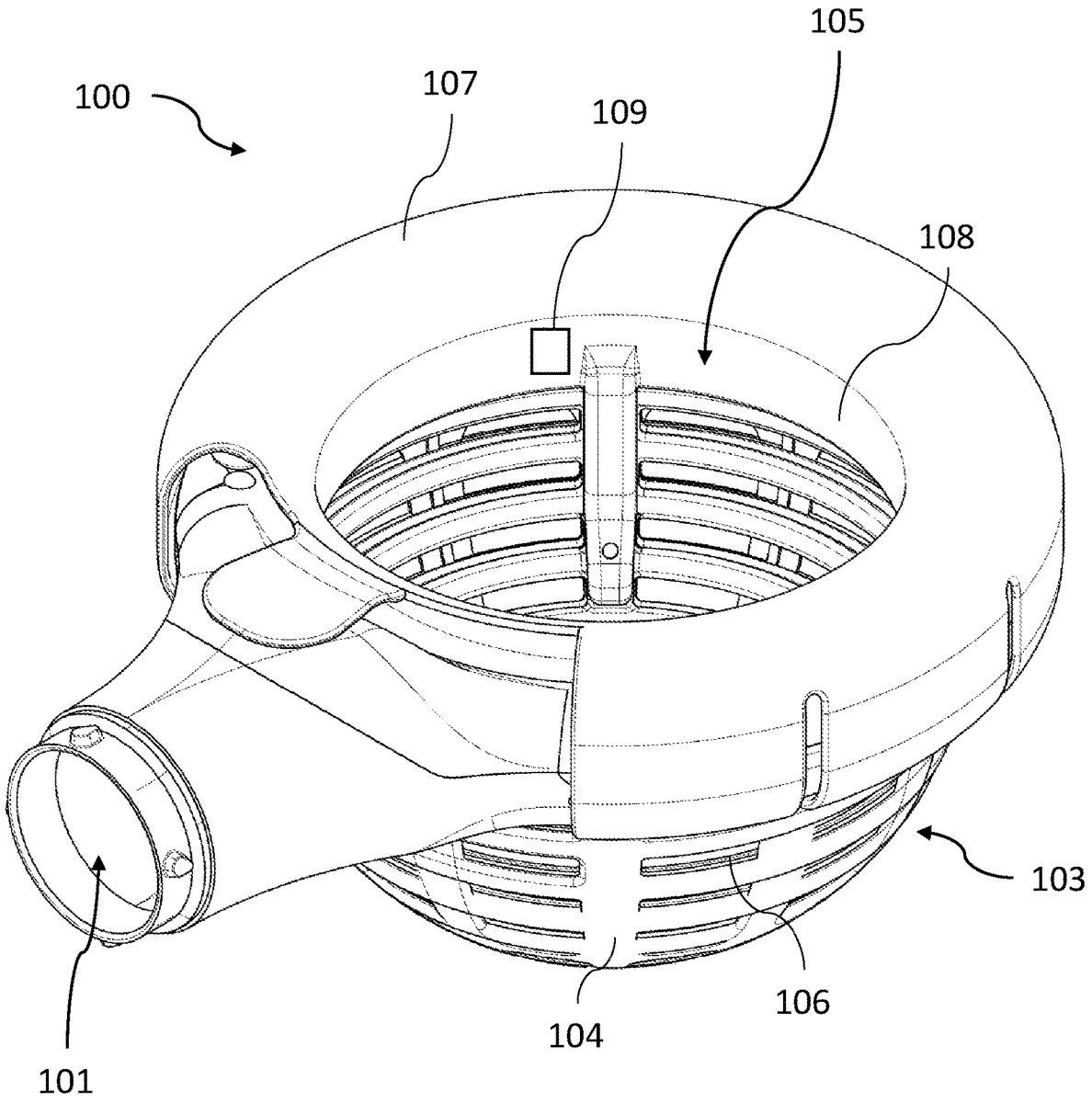
FIG. 3 illustrates a schematic view of an attachment for the haircare appliance of FIG. 1.
Figure 4:
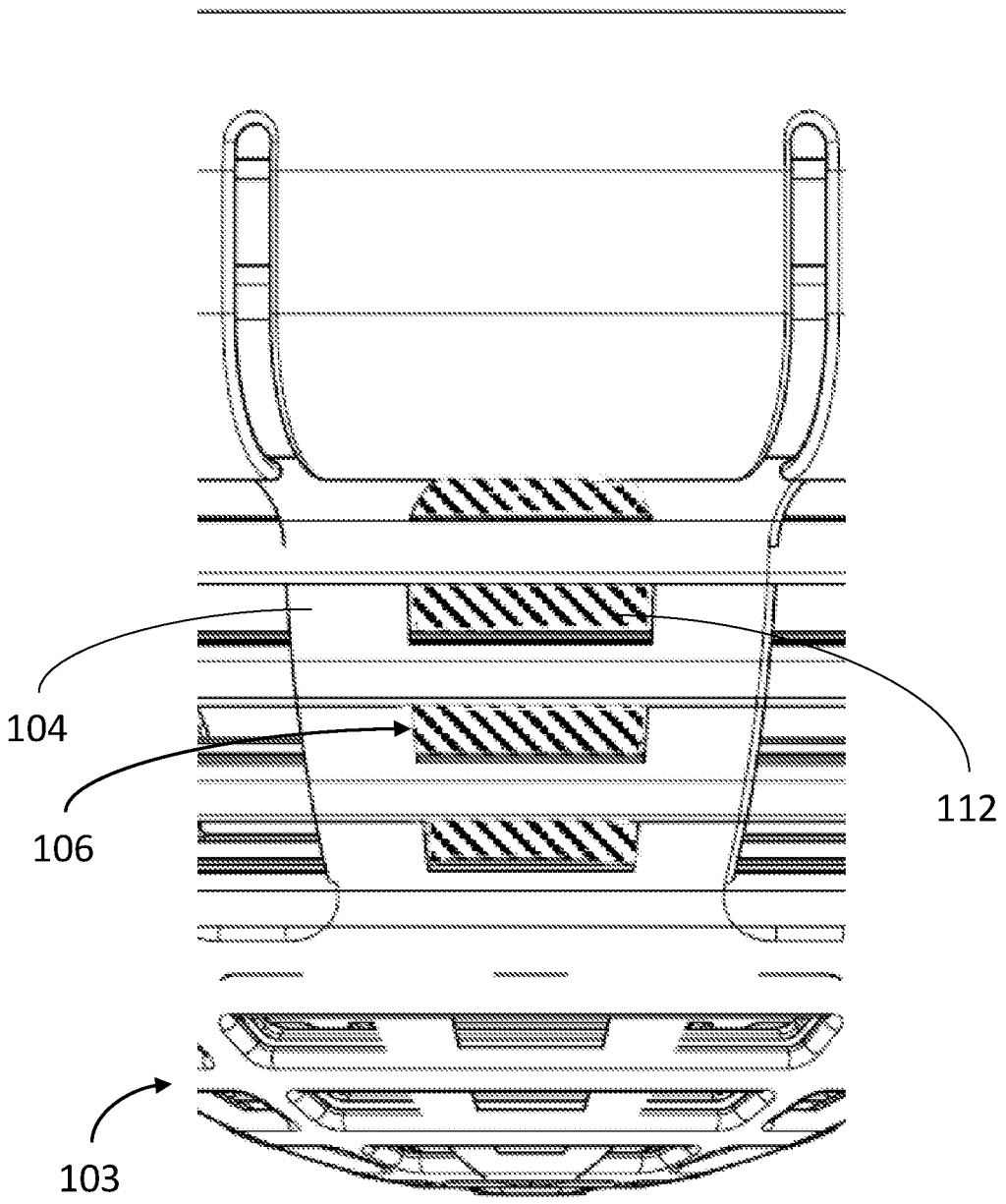
FIG. 4 illustrates a schematic side view of a part of the attachment of FIG. 2.

Examples of the attachment 100 are shown schematically in FIGS. 3 to 5. The attachment 100 comprises an air inlet 101, an air outlet 102 and a hair treatment chamber 103. The hair treatment chamber 103 comprises a wall 104, an opening 105 through which hair is insertable into the hair treatment chamber 103, and an aperture 106 formed in the wall 104. The attachment 100 comprises a first configuration in which airflow through the aperture 106 is unrestricted and a second configuration in which airflow through the aperture 106 is restricted. In the example shown in FIGS. 3 to 5, the air outlet 102 is configured to direct airflow away from the opening 105 and toward the aperture 106 in use.

The hair treatment chamber 103 defines a confined space into which the user's hair is placed. As hot air passes into the confined space, the ambient temperature within the hair treatment chamber 103 rises, which can help dry the hair of the user. Moreover, as the hair treatment chamber 103 holds the user's hair in place during use, the user's hair is less likely to be disrupted by the flow of air into the hair treatment chamber 103. As such, relatively high flow rates of air can be used without significantly disrupting the user's hair, which may increase the efficiency and/or speed of drying the user's hair. The flow rate may be at least 6 litres per second, at least 10 litres per second, or at least 13 litres per second.

As shown in FIGS. 3 to 5, the wall 104 of the hair treatment chamber 103 comprises a plurality of apertures 106. The plurality of apertures 106 are evenly spaced in the wall 104 of the hair treatment chamber 103. Providing a plurality of apertures 106 allows for more diffuse airflow from the hair treatment chamber 103.

In the example of FIGS. 3 to 5 in combination with FIG. 1, the air inlet 101 and the air outlet 102 of the attachment 100 are provided at a first end of the housing 14. The air inlet 101 is therefore disposed in an airflow path between the airflow generator 16 and the air outlet 102. As shown in FIG. 1, the handle unit 12 also has its own air inlet 22 into the housing 14. The airflow generator 16 is configured to generate an airflow from the air inlet 22 of the handle unit 12, through the air inlet 101 of the attachment 100 and to the air outlet 102 in use.

The opening 105 illustrated in FIG. 3 is generally circular in shape, however other forms and shapes of opening are envisaged. For example, the opening 105 may be substantially oval or semi-circular shaped. In the example shown in FIG. 3, the hair treatment chamber 103 is shaped to define a hemi-spherical interior. In other examples, the hair treatment chamber 103 is shaped to define any other suitable hollow interior in which hair can be received, such as a substantially toroidal interior.

The opening 105 of the hair treatment chamber 103 comprises a rim 107. The air outlet 102 (shown in FIG. 5) is located on the rim 107 such that airflow is directed away from a periphery 108 of the opening 105 into the hair treatment chamber 103.

FIG. 4 illustrates a side view of a part of the attachment 100 of FIG. 3. The wall 104 of the hair treatment chamber 103 comprises a porous material 112. In the example shown in FIG. 4, the porous material 112 is disposed in the aperture 106 such that collectively the wall 104, which is non-porous, and the porous material, define a boundary wall of the hair treatment chamber 103. In some examples, the porous material 112 is disposed in all of the apertures 106. Alternatively, the porous material 112 is disposed in a select number of apertures 106. Pores of the porous material 112 define further apertures in the wall 104. In the example of FIG. 4, the porous material 112 is a mesh. Alternatively, any other suitably porous material 112 can be used.

The porous material 112 helps to retain the hair of a user within the hair treatment chamber 103 while also confining the air in the hair treatment chamber 103. As such, air in the hair treatment chamber 103 may heat to higher temperatures to increase the efficiency and/or speed of drying the user's hair.

The attachment 100 comprises a sensor 109 configured to output a signal indicative of a property of hair within the hair treatment chamber 103 in use. The sensor 109 shown in FIGS. 3 and 4 is a moisture sensor. In other examples, the sensor 109 is a temperature sensor or a humidity sensor. The signal output by the sensor 109 is received by the control module 34 which is configured to control the haircare appliance 10 in response to the signal from the sensor 109. In some examples, the sensor 109 comprises an RFID tag to transmit information via RFID to the RFID reader 24. In some examples, it is envisaged that other forms of communication, including, for example Bluetooth™ or near-field communication (NFC), may be utilised.

Similarly, although thus far wireless methods of communicating between the sensor 109 and the control module 34 have been discussed, it will be appreciated that examples that utilise physical communications connections are also envisaged. For example, the handle unit 12 and the attachment 100 may comprise corresponding contacts which, when connected when the attachment 100 is connected to the handle unit 12, define a communications pathway.

In some examples, the signal from the sensor 109 is indicative of the user's hair being sufficiently dry and the user is provided with an indication to stop using the haircare appliance 10 based on the signal. For example, the user is provided with a visual indicator, such as a light, when the signal indicates that their hair is sufficiently dry. In some examples, the airflow generator 16 is configured to modify the airflow when the signal indicates that the user's hair is sufficiently dry. For example, the airflow generator 16 is configured to reduce the flow rate, or stop the generation of airflow, in response to the signal. In some examples, the heater 18 is configured to modify the amount of heat provided to the airflow in response to the signal. For example, the heater 18 may be configured to reduce the amount of heat provided to the airflow, or stop heating the airflow, in response to the signal. This may help to prevent damage to the user's hair which may be caused by excessive or unnecessary drying and/or heating.

In some examples, the attachment 100 is configured to switch from the second configuration to the first configuration in response to the signal from the sensor 109. For example, if the signal is indicative of the user's hair being sufficiently dry, the attachment 100 is configured to switch to the first configuration to prevent damage to the user's hair which may be caused by excessive or unnecessary drying and/or heating. In such examples movement between the first and second configurations may be driven by a mechanism such as a motor or the like.

Figure 5A:
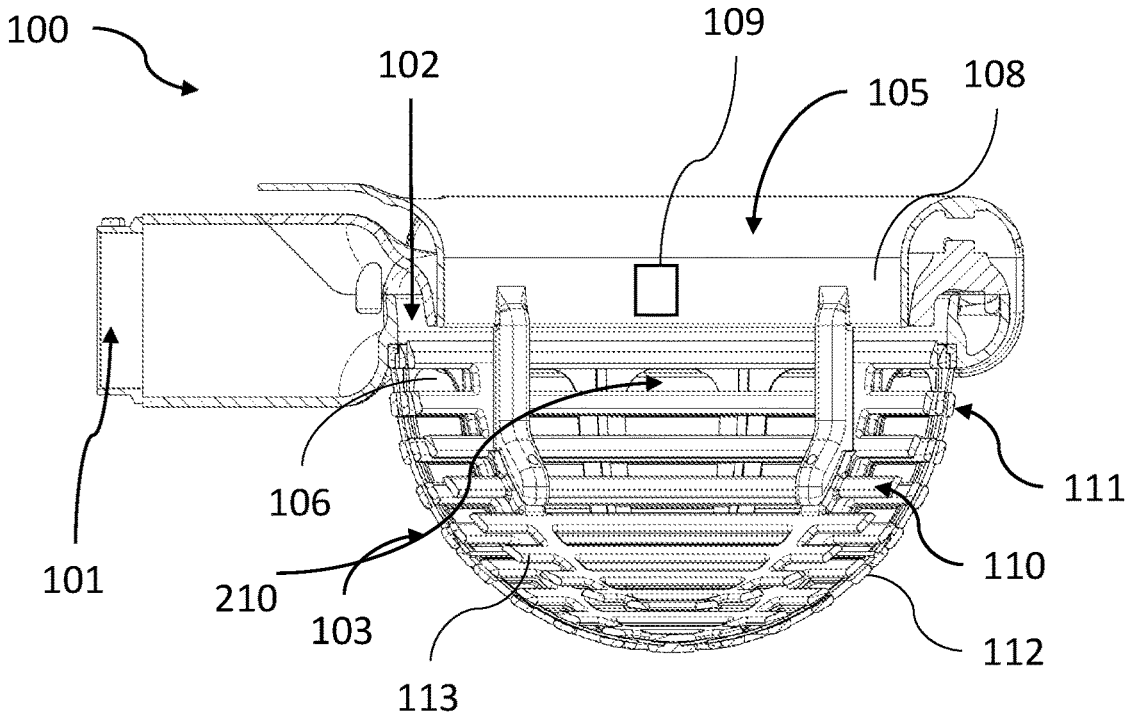
FIG. 5*a* illustrates a schematic cross-sectional view illustrating a first configuration of the attachment of FIG. 2.
Figure 5B:
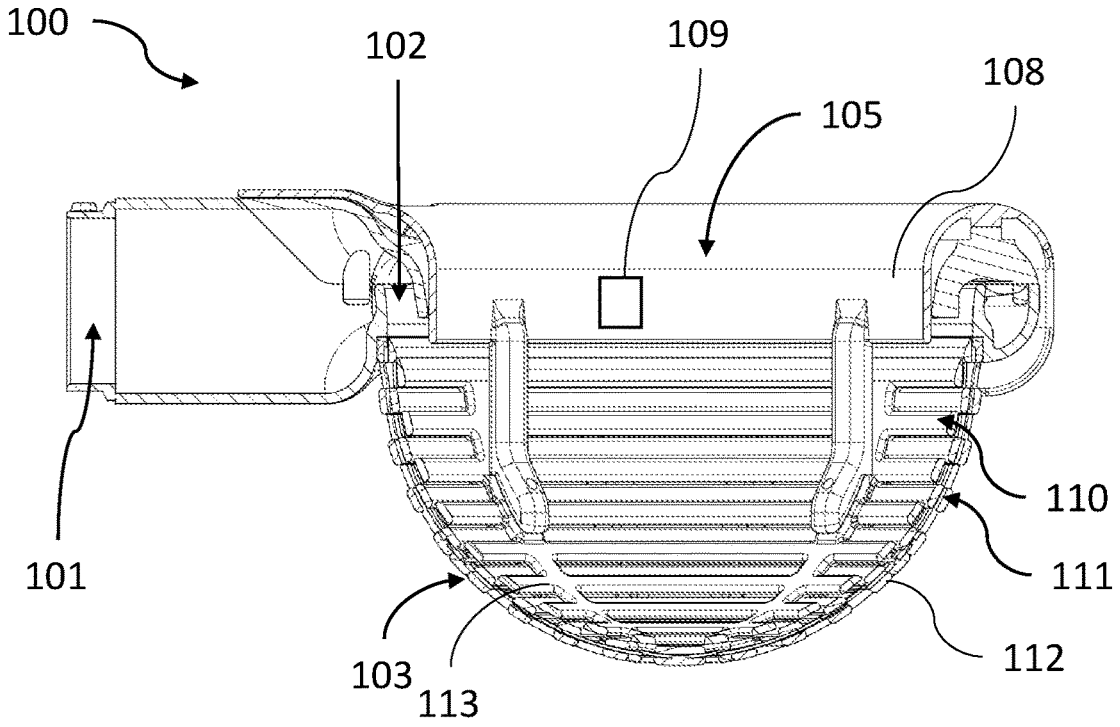
FIG. 5*b* illustrates a schematic cross-sectional view illustrating a second configuration of the attachment of FIG. 2.

FIG. 5*a* illustrates the first configuration of the attachment 100 in which airflow through the aperture 106 is unrestricted. FIG. 5*b* illustrates the second configuration of the attachment 100 in which airflow through the aperture 106 is restricted. As can be seen in FIG. 5*b*, when the attachment 100 is in the second configuration, the apertures 106 are obstructed. In the example of FIGS. 5*a* and 5*b* (collectively FIG. 5), the attachment 100 is biased into the first configuration. As such, the attachment 100 is biased such that airflow through the apertures 106 is unrestricted. This may help to prevent the temperature within the hair treatment chamber 103 from becoming inadvertently too hot. In other examples, the attachment 100 is biased into the second configuration. Alternatively, the attachment 100 is not biased into either configuration. The biasing may be achieved by airflow flowing through the attachment 100 in use, or alternatively may be achieved via use of a resiliently deformable member such as a spring.

As shown in FIG. 5*b*, in the second configuration, airflow is prevented from flowing through the aperture 106. In other words, substantially no airflow passes through the aperture 106 in the second configuration. This helps to increase the temperature within the hair treatment chamber 103, increase the speed and efficiency of drying the user's hair.

The wall 104 of the hair treatment chamber 103 comprises an inner wall section 110 and an outer wall section 111. A plurality of orifices 210 are formed in the inner wall section 110 and the plurality of apertures 106 are formed in the outer wall section 111. In the first configuration, the plurality of orifices 210 in the inner wall section 110 are aligned (or at least partially aligned) with the plurality of apertures 106 in the outer wall section 111 such that airflow can pass through the apertures 106. In the second configuration, the plurality of orifices 210 in the inner wall section 110 are at least partially misaligned with the plurality of apertures 106 in the outer wall section 111 to restrict airflow through the apertures 106.

In the example of FIG. 5, the outer wall section 111 and the inner wall section 110 comprise a plurality of bars 112, 113 which extend circumferentially around the interior of the hair treatment chamber 103. The spaces between the bars 112 of the outer wall section 111 define the apertures 106 and the spaces between the bars 113 of the inner wall section 110 define the orifices 210. In the second configuration, the bars 112 of the inner wall section 110 cover the apertures 106 to restrict airflow through the apertures 106. In alternative examples, the bars 113 of the inner wall section 110 and the bars 112 of the outer wall section 111 extend along the respective one of the inner wall section 110 and the outer wall section 111 from a first side of the rim 107, through the apex of the hair treatment chamber 103, to a second side of the rim 107 opposite the first side. In this example, the inner wall section 110 rotates relative to the outer wall section 111 between the first configuration and the second configuration.

As shown in FIGS. 5*a* and 5*b*, the outer wall section 111 defines a hemi-spherical interior of the hair treatment chamber 103 and the inner wall section 110 defines a hemi-spherical shape. The inner wall section 110 is disposed radially adjacent the outer wall section 111 such that the inner wall 110 section is provided within the hemi-spherical interior of the hair treatment chamber 103.

In the example shown in FIGS. 3 to 5, the outer wall section 111 is fixed relative to the air inlet 101 and the inner wall section 110 is moveable within the outer wall section 111. As the moveable part (the inner wall section 110) is within the hair treatment chamber 103 (and not of the outside of the hair treatment chamber 103), this helps to prevent the user from potentially trapping their fingers in the moveable part and helps to prevent the build-up of dirt inhibiting the movement of the moveable part.

In some examples, the attachment 100 comprises a switching arrangement to switch between the first configuration and the second configuration. This allows for the attachment 100 to be switched from the first configuration to the second configuration either manually or automatically. In the example shown in FIGS. 3 to 5, the switching arrangement comprises the rim 107 which is depressible in the same direction as airflow from the air outlet 102. In use, the attachment 100 switches from the first configuration to the second configuration when the rim 107 is depressed. This may be achieved by a user placing the rim 107 against their head and providing a force to the rim 107 to depress the rim 107. The rim 107 is operatively connected to the inner wall section 110 such that movement of the rim 107 causes relative movement of the inner wall section 110. When the attachment 100 is biased into the first configuration, when the user moves the rim 107 away from the head, the attachment 100 switches to the first configuration. This allows the user to easily switch the attachment 100 between the first configuration and the second configuration without having to use another hand.

In some examples, the airflow generator 16 is configured to modify the airflow when the rim 107 is depressed. For example, the airflow generator 16 is configured to reduce the flow rate, or stop the generation of airflow, when the rim 107 is depressed. In some examples, the heater 18 is configured to modify the amount of heat provided to the airflow when the rim 107 is depressed. For example, the heater 18 may be configured to reduce the amount of heat provided to the airflow, or stop heating the airflow, in response to the rim 107 being depressed.

Figure 6A:
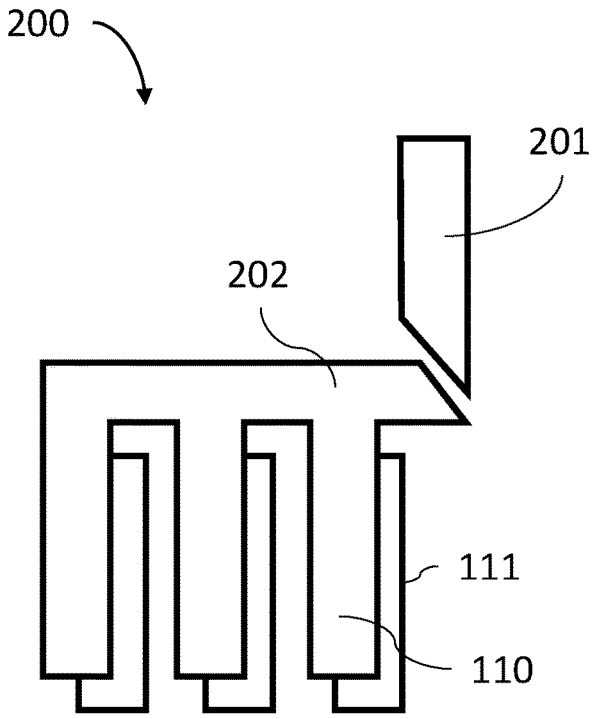
FIGS. 6*a* to 9*b* illustrate schematic cross-sectional views of example switching arrangements for switching between the first and second configurations of FIGS. 5*a* and 5*b*.
Figure 6B:
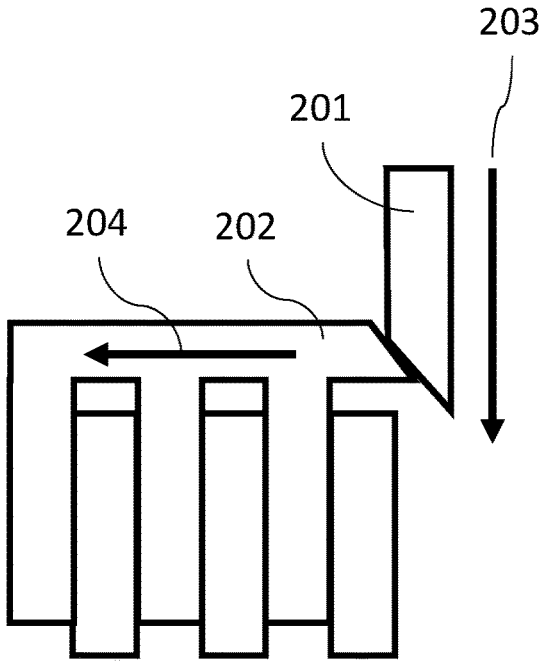

FIGS. 6 to 9 illustrate further example switching arrangements 200, 300, 400, 500. FIGS. 6*a* and 6*b* (collectively FIG. 6) illustrate a switching arrangement 200 comprising a wedge cam. The wedge cam comprises a cam element 201 and a follower 202. The follower 202 is operatively connected to the inner wall section 110 such that movement of the follower 202 causes movement of the inner wall section 110 relative to the outer wall section 111. As shown in FIG. 6, as the cam 201 moves linearly in a first direction 203, a part of the cam 201 contacts the follower 202, causing the follower 202 to move in a second direction 204, moving the inner wall element 110 toward the second configuration. The switching arrangement 200 of FIG. 6 may be usable in an example where the inner wall section 110 rotates inside the outer wall section 111, for example such that bars of the inner wall section 110 and the outer wall section 111 are selectively aligned and misaligned via movement in a circumferential direction. Alternatively, the orientation of the switching arrangement 200 can be rotated through 90 degrees relative to what is shown in FIG. 6, to be usable in an example where the inner wall section 110 linearly slides inside the outer wall section 111 with bars 113 of the inner wall section 110 moving in a direction along the central axis of the hair treatment chamber 103 (as shown in FIGS. 3 to 5).

Figure 7A:
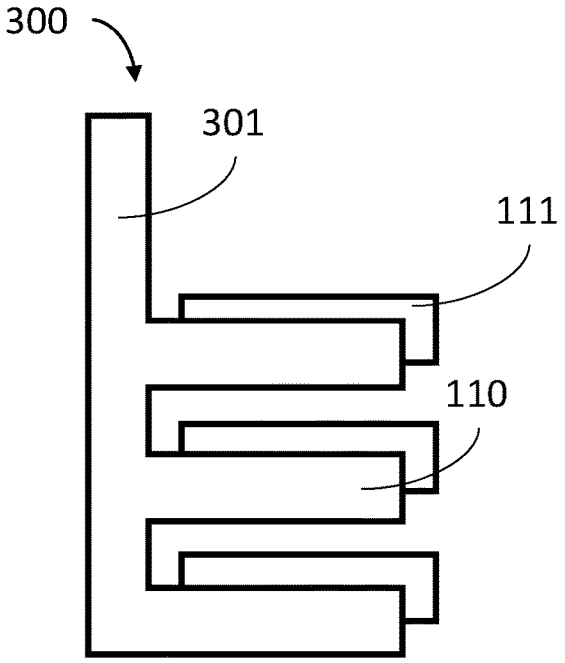
Figure 7B:
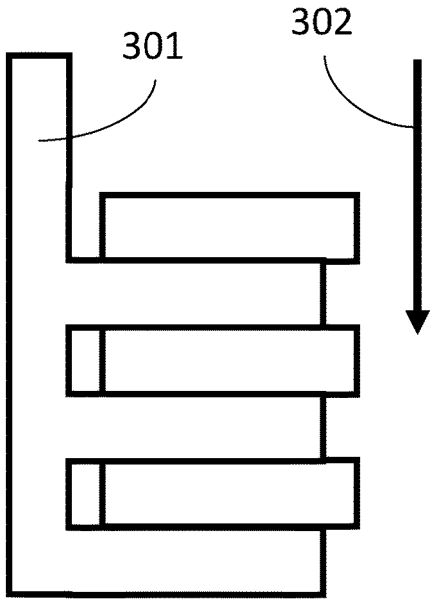

FIGS. 7*a* and 7*b* (collectively FIG. 7) illustrate a switching arrangement 300 wherein the inner wall section 110 is connected to a rod 301. When a force is applied to the rod 301 in a first direction 302, the inner wall section 110 moves in the first direction 302 (as shown in FIG. 7*b*) toward the second configuration. This switching arrangement 300 is suitable for use with the attachment 100 illustrated in FIGS. 3 to 5.

Figure 8A:
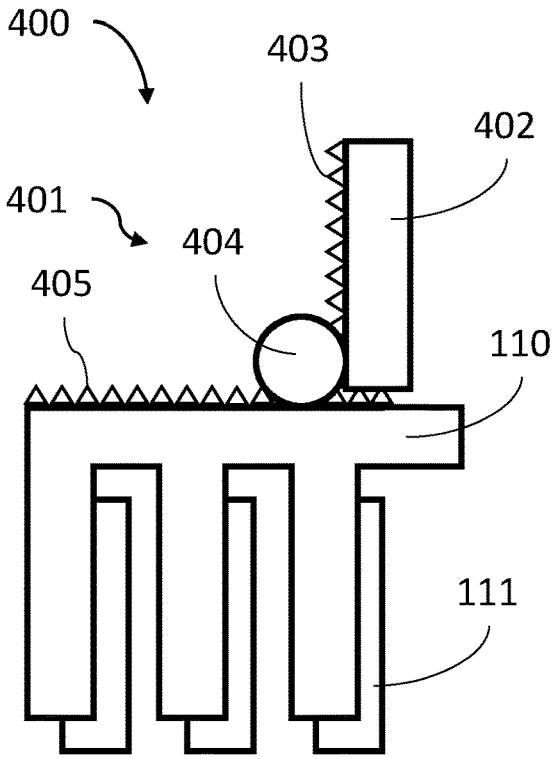
Figure 8B:
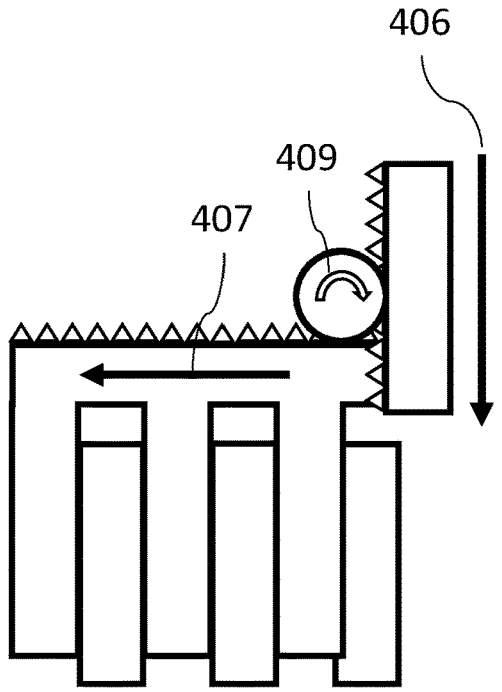

FIGS. 8*a* and 8*b* (collectively FIG. 8) illustrate a switching arrangement 400 comprising a rack and pinion arrangement 401. A moveable member 402 comprises a plurality of teeth 403 configured to engage with a gear arrangement 404. A part of the inner wall section 110 comprises a plurality of teeth 405 configured to engage with the gear arrangement 404. As the moveable member 402 moves in a first direction 406, the gear arrangement 404 is rotated in a rotational direction 409 (shown in FIG. 8*b*), which causes the inner wall section 110 to move in a second, circumferential direction 407 relative to the outer wall section 111 toward the second configuration. As shown in FIG. 8, the second direction 407 is orthogonal to the first direction 406, although it will be appreciated that this may be different when the hair treatment chamber 103 is generally hemi-spherical as shown in FIGS. 3 to 5. In the example shown in FIG. 8, the gear arrangement 404 comprises a single gear 408. In other examples, the gear arrangement 404 comprises a plurality of gears 408. For example, the gear arrangement 404 may be configured such that a small movement of the moveable member 402 results in relatively larger movement of the inner wall section 110. As with the switching arrangement 200 of FIG. 6, the switching arrangement 400 of FIG. 8 may be usable in an example where the inner wall section 110 rotates inside the outer wall section 111. Alternatively, the orientation of the switching arrangement 200 can be rotated through 90 degrees to be usable in an example where the inner wall section 110 linearly slides inside the outer wall section 111 (as shown in FIGS. 3 to 5).

Figure 9A:
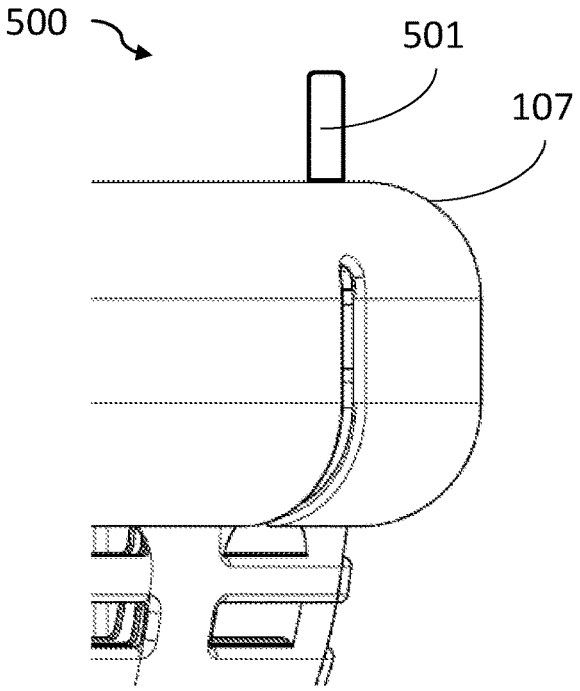
Figure 9B:
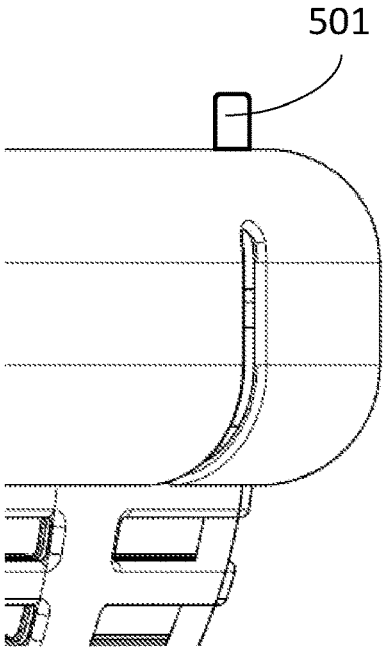

FIGS. 9*a* and 9*b* (collectively FIG. 9) illustrate a switching arrangement 500 comprising a protrusion 501 extending from the attachment 100. In the first configuration, the protrusion 501 extends from the rim 107 of the attachment by a first extent. The protrusion 501 is configured to be depressed upon the application of a force to an end of the protrusion 501. As shown in FIG. 9*b*, when a force is applied to the protrusion 501, the protrusion 501 is depressed such that it extends from the rim 107 by a second extent smaller than the first extent. The protrusion 501 can be operatively connected to any one of the switching arrangements 200, 300, 400 discussed in relation to FIGS. 6 to 8 such that depression of the protrusion 501 causes the attachment 100 to switch from the first configuration to the second configuration.

In some examples, the switching mechanisms 200, 300, 400, 500 discussed above are operatively connected to the rim 107 of the attachment 100 such that movement of the rim 107 operated the switching mechanisms 200, 300, 400, 500. For example, the moveable member 402 shown in FIG. 8 is operatively connected to the rim 107 such that when the rim 107 is depressed, the moveable member 402 moves in the first direction 406. As such, the moveable members 200, 300, 400, 500 can be enclosed within the rim 107 of the attachment 100, which may decrease the size of the attachment 100 and help to ensure that the moving parts are protected from the outside environment and from the user accidentally touching the moveable parts and trapping their fingers.

Examples are also envisaged where, rather than the haircare appliance 10 comprising a handle unit 12 and an attachment 100, the haircare appliance 10 is a single-piece unit, for example taking the form of the combined handle unit 12 and attachment 100 previously described.

The invention claimed is:

1. An attachment for a haircare appliance, the attachment comprising an air inlet, an air outlet for emitting an airflow, and a hair treatment chamber for receiving hair, the hair treatment chamber in fluid communication with the air outlet; wherein the hair treatment chamber comprises a wall, an opening through which hair is insertable into the hair treatment chamber, and an aperture formed in the wall, and wherein the attachment comprises a first configuration in which airflow through the aperture is unrestricted and a second configuration in which airflow through the aperture is restricted.

2. The attachment as claimed in claim 1, wherein the haircare appliance is biased into the first configuration.

3. The attachment as claimed in claim 1, wherein airflow is prevented from flowing through the aperture in the second configuration.

4. The attachment as claimed in claim 1, wherein the wall comprises an inner wall section and an outer wall section, the aperture being formed in the outer wall section, the inner wall section being disposed adjacent the outer wall section, the inner wall section comprising an orifice corresponding to the aperture, and the inner wall section being moveable relative to the outer wall section, wherein in the first configuration the aperture of the outer wall section is aligned with the orifice of the inner wall section and in the second configuration the aperture of the outer wall section is at least partially misaligned with the orifice of the inner wall section.

5. The attachment as claimed in claim 1, wherein the attachment comprises a switching arrangement configured to switch the attachment between the first configuration to the second configuration.

6. The attachment as claimed in claim 5, wherein the opening comprises a rim, the rim being depressible in the same direction as airflow from the air outlet and wherein the switching arrangement comprises the rim.

7. The attachment as claimed in claim 5, wherein the switching arrangement comprises at least one of a rack and pinion arrangement or a wedge cam.

8. The attachment as claimed in claim 5, wherein the switching arrangement comprises a protrusion extending from a part of the attachment and the switching arrangement is configured to switch the attachment from the first configuration to the second configuration when a force is applied to the protrusion.

9. The attachment as claimed in claim 7, wherein the outer wall section is fixed relative to the air inlet.

10. The attachment as claimed in claim 8, wherein the inner wall section is movable within the outer wall section.

11. The attachment as claimed in claim 1, wherein the air outlet is configured to direct airflow away from the opening and toward the aperture in use.

12. The attachment as claimed in claim 1, wherein the attachment comprises a plurality of apertures formed in the wall, and wherein in the first configuration airflow through the plurality of apertures is unrestricted and in the second configuration airflow through the plurality of apertures is restricted.

13. The attachment as claimed in claim 1, wherein the wall comprises porous material.

14. The attachment as claimed in claim 13, wherein the porous material defines the aperture.

15. The attachment as claimed in claim 1, wherein the attachment comprises a sensor configured to output a signal indicative of a property of hair within the hair treatment chamber.

16. The attachment as claimed in claim 14, wherein the attachment is configured to switch from the second configuration to the first configuration in response to the signal.

17. A haircare appliance comprising:

an air inlet;

an air outlet;

an airflow generator for generating an airflow from the air inlet to the air outlet;

and a hair treatment chamber for receiving hair, the hair treatment chamber in fluid communication with the air outlet;

wherein the hair treatment chamber comprises a wall, an opening through which hair is insertable into the hair treatment chamber, and an aperture formed in the wall, and wherein the haircare appliance comprises a first configuration in which airflow through the aperture is unrestricted and a second configuration in which airflow through the aperture is restricted.

18. The haircare appliance as claimed in claim 17, wherein the haircare appliance comprises a handle unit within which the airflow generator is disposed, and an attachment comprising the air inlet, the air outlet and the hair treatment chamber, the attachment removably attachable to the handle unit.

* * * * *